US006312236B1

(12) United States Patent
Abe et al.

(10) Patent No.: US 6,312,236 B1
(45) Date of Patent: Nov. 6, 2001

(54) SCROLL COMPRESSOR HAVING A ROTATED OLDHAM RING

(75) Inventors: Yoshifumi Abe; Takao Fujita; Makoto Iwasa, all of Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/463,827

(22) PCT Filed: Jun. 4, 1998

(86) PCT No.: PCT/JP98/02492

§ 371 Date: May 25, 2000

§ 102(e) Date: May 25, 2000

(87) PCT Pub. No.: WO99/63227

PCT Pub. Date: Dec. 9, 1999

(30) Foreign Application Priority Data

Jun. 3, 1997 (JP) ..... 9-144875

(51) Int. Cl.[7] ..... F04C 18/04
(52) U.S. Cl. ..... 418/55.3
(58) Field of Search ..... 418/55.3; 464/102

(56) References Cited

U.S. PATENT DOCUMENTS 4,325,683 * 4/1982 Miyazawa ..... 418/55.3
5,342,184 * 8/1994 Comparin et al. ..... 418/55.3

FOREIGN PATENT DOCUMENTS 63-88287 4/1988 (JP) .
3-281996 * 12/1991 (JP) ..... 418/55.3
4-219401 8/1992 (JP) .
5-44659 2/1993 (JP) .

* cited by examiner

*Primary Examiner*—John J. Vrablik
(74) *Attorney, Agent, or Firm*—Wenderoth, Lind & Ponack, L.L.P.

(57) ABSTRACT

A small-size scroll compressor is provided wherein strength of key portions has been enhanced without increasing ring width, ring diameter or key widths of an Oldham's ring. In the Oldham's ring 31, a rotated elliptical ring 31*b* is formed on x- and y-axes of coordinates by rotating an elliptical ring 31*a* having axes of coordinates of the major axis and the minor axis respectively in a first radial direction (X-axis) and in a second radial direction (Y-axis) by a predetermined angle in a direction reverse to the direction of revolution of the shaft, and first keys 34, 35 and second keys 37, 38 are respectively opposingly disposed in the first radial direction and in the second radial direction on the rotated elliptical ring 31*b*. By employing this configuration, the ring width, ring diameter or key widths of the Oldham's ring 31 do not need to be increased, and the length of arm from the point of stress concentration on the bases of the key portions can be shortened, thus relieving the bending moments of the keys and resulting in the control of vibration during high-speed, high-pressure operation and in the improvement of the durability of the key portions.

2 Claims, 7 Drawing Sheets

SCROLL COMPRESSOR HAVING A ROTATED OLDHAM RING

TECHNICAL FIELD OF THE INVENTION

The present invention relates to a scroll compressor for use in air-conditioning apparatuses and the like, and in particular to configurational improvement of an Oldham's ring of a rotation preventing mechanism.

BACKGROUND OF THE TECHNOLOGY

As shown in FIG. 6, in a drive mechanism of this type of a scroll compressor in general, a shaft 3 is supported in a housing 1 by a bearing 2, a boss portion is formed on the central portion of an orbiting scroll end plate 5*a* opposite a fixed scroll 4, and the shaft 3 is coupled with an orbiting bushing 7 by affixing on the boss portion an orbiting bearing 6 in which the orbiting bushing 7 is inserted, thereby enabling orbiting motion of an orbiting scroll 5 relative to the fixed scroll 4 by the rotation of the shaft 3. Also, a suction port 8 for sucking a refrigerant as a working fluid is provided on the housing 1 on the side of the low pressure chamber, and a discharge port 10 for discharging compressed refrigerant is provided on a housing 9 on the high pressure side.

In this configuration, a rotation preventing mechanism forces the orbiting scroll 5 to orbit while hampering its rotation. The mechanism includes first engagement means movable between an elliptical Oldham's ring 11 shown in FIGS. 7(*a*) and 7(*b*) and the orbiting scroll 5 only in a first radial direction (direction of the X-axis), and second engagement means movable between the housing 1 and the Oldham's ring 11 only in a second radial direction (direction of the Y-axis) perpendicular to the first radial direction.

The first engagement means comprises a pair of key ways (first key ways) provided on the orbiting scroll end plate 5*a* in the first radial direction and a pair of first keys 11*a* provided on the Oldham's ring 11, each of the first keys respectively fitting with each of the first key ways and slidable along the first key ways and a thrust plate 12. The second engagement means comprises a pair of key ways (second key ways) provided on the housing 1 in a second radial direction and a pair of second keys 11*b* provided on the Oldham's ring 11, each of the second keys respectively fitting with each of the second key ways and slidable along the second key ways and the thrust plate 12. The mechanism is configured in a manner such that the rotation of the orbiting scroll 5 is hampered by the first engagement means and the second engagement means while its orbiting motion is allowed. As another example, there is also a configuration in which a circular ring is used in place of the elliptical ring used in the ring portion of the Oldham's ring 11.

However, in the above described construction of the rotation hampering mechanism, the Oldham's ring 11 is disposed in a manner such that each of the key pairs 11*a* and 11*b* are opposingly disposed respectively on the x- and y-axes (in the first and second radial directions) of an elliptical ring having major and minor axes. As a result, it suffered a problem of the key portions being damaged because reciprocating force of inertia of the Oldham's ring 11 increases during a high-speed high-pressure operation thus imposing an excessive load on the key portions. In order to secure a sufficient strength of the key portions, it is necessary to make the reciprocating force of inertia of the Oldham's ring 11 small. For this purpose, it is necessary to widen the ring width, ring diameter or the key widths of the Oldham's ring 11, which will result in an increase in the size of the scroll compressor as a whole thus harming salability of the product.

DISCLOSURE OF THE INVENTION

The present invention addresses the above-described problems and is intended to provide a scroll compressor in which the strength of the key portions is enhanced without increasing the ring width, ring diameter or the key widths of the Oldham's ring.

In order to accomplish the above object, in the scroll compressor of the present invention, an Oldham's ring is provided with first and second keys opposingly disposed on a rotated elliptical ring formed by rotating an elliptical ring having the major axis and the minor axis respectively in a first radial direction (direction of the X-axis) disposed with the first keys and in a second radial direction (direction of the Y-axis) disposed with the second keys by a predetermined angle in the direction reverse to the direction of rotation of the shaft. This shortens the length of arm from the point of stress concentration in the base of the key portion on the side of each key on which a load is imposed without increasing the ring width, ring diameter or the key widths of the Oldham's ring, thus relieving the bending moments of the keys, controlling vibration during high-speed, high-pressure operation as well as enhancing the durability of the key portions.

To describe in detail, in the scroll compressor in accordance with the present invention, a rotation preventing mechanism comprises first engagement means disposed in between an Oldham's ring and an orbiting scroll and reciprocatingly movable only in a first radial direction, and second engagement means disposed between the Oldham's ring and a housing and reciprocatingly movable only in a second radial direction substantially perpendicular to the first radial direction. The first engagement means comprises a pair of key ways (first key ways) provided on an orbiting scroll end plate in the first radial direction and a pair of first keys provided on the Oldham's ring and respectively fitting in each of the first key ways and slidable along the first key ways, and the second engagement means comprises a pair of key ways (second key ways) provided in the housing in a second radial direction and a pair of second keys provided on the Oldham's ring and respectively fitting in each of the second key ways and slidable along the second key ways. The Oldham's ring is disposed in a manner such that the first pair of keys and the second pair of keys are respectively opposingly disposed in the first radial direction and the second radial direction on a rotated elliptical ring formed by rotating an elliptical ring having the major axis and the minor axis respectively in the first radial direction and in the second radial direction by a predetermined angle in the direction reverse to the direction of rotation of the shaft.

Also the Oldham's ring is configured in a manner such that a part of the elliptical curve between the axis of coordinates on the major axis side and axis of coordinates on the minor axis side of the rotated elliptical ring consists of an arc.

By employing the above configuration, on the surface of each key on which a load is imposed, the bending moment of the key can be relieved as the arm length from the point of stress concentration on the base of the key portion is shortened, thereby allowing enhancement of the strength of the key portion without increasing the ring width, ring diameter, or key width as well as miniaturization of the Oldham's ring and downsizing of the scroll compressor as a whole.

DESCRIPTION OF THE PREFERRED EMBODIMENTS

Figure 1:
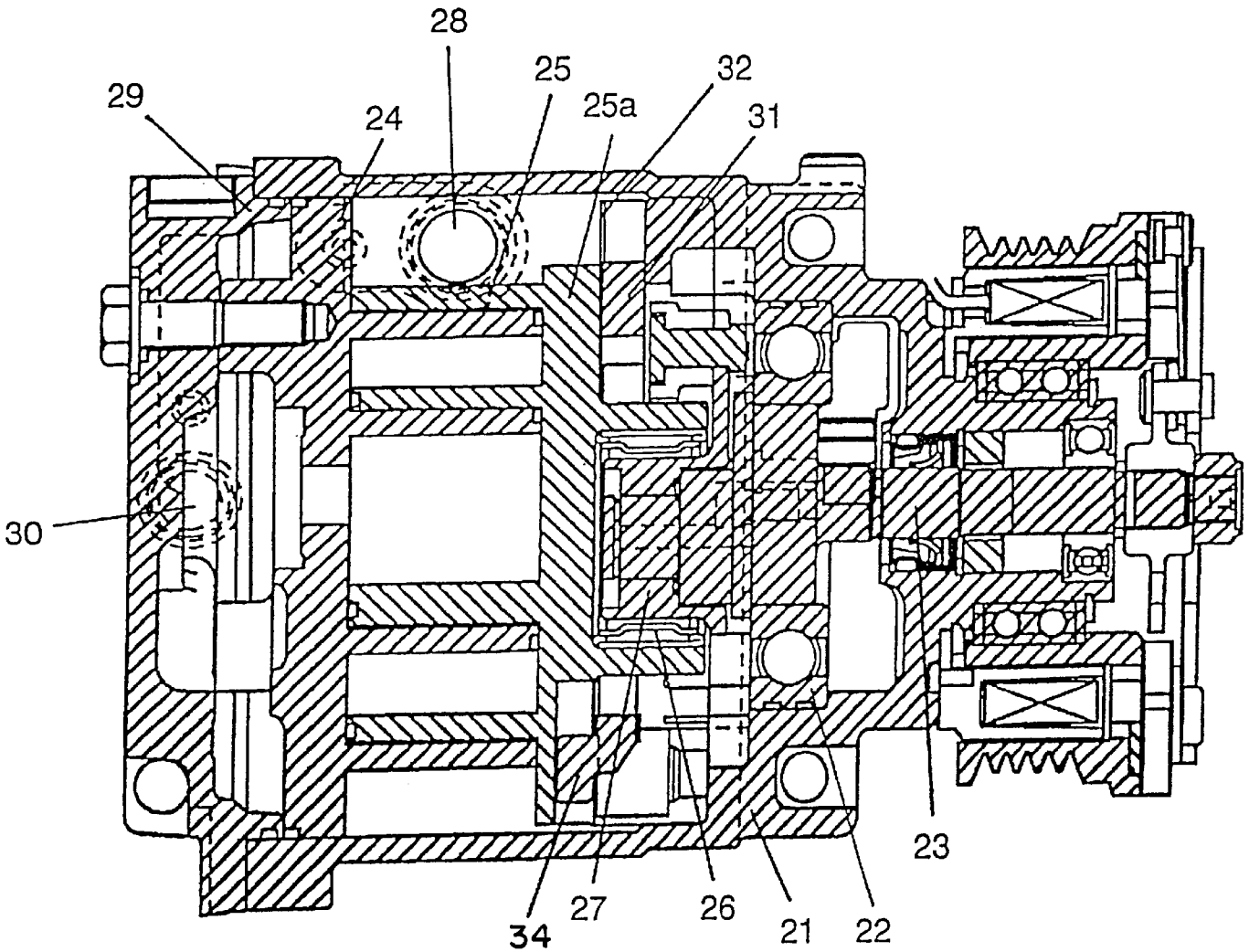
FIG. 1 is a cross-sectional view of a scroll compressor in a first exemplary embodiment of the present invention.
Figure 2:
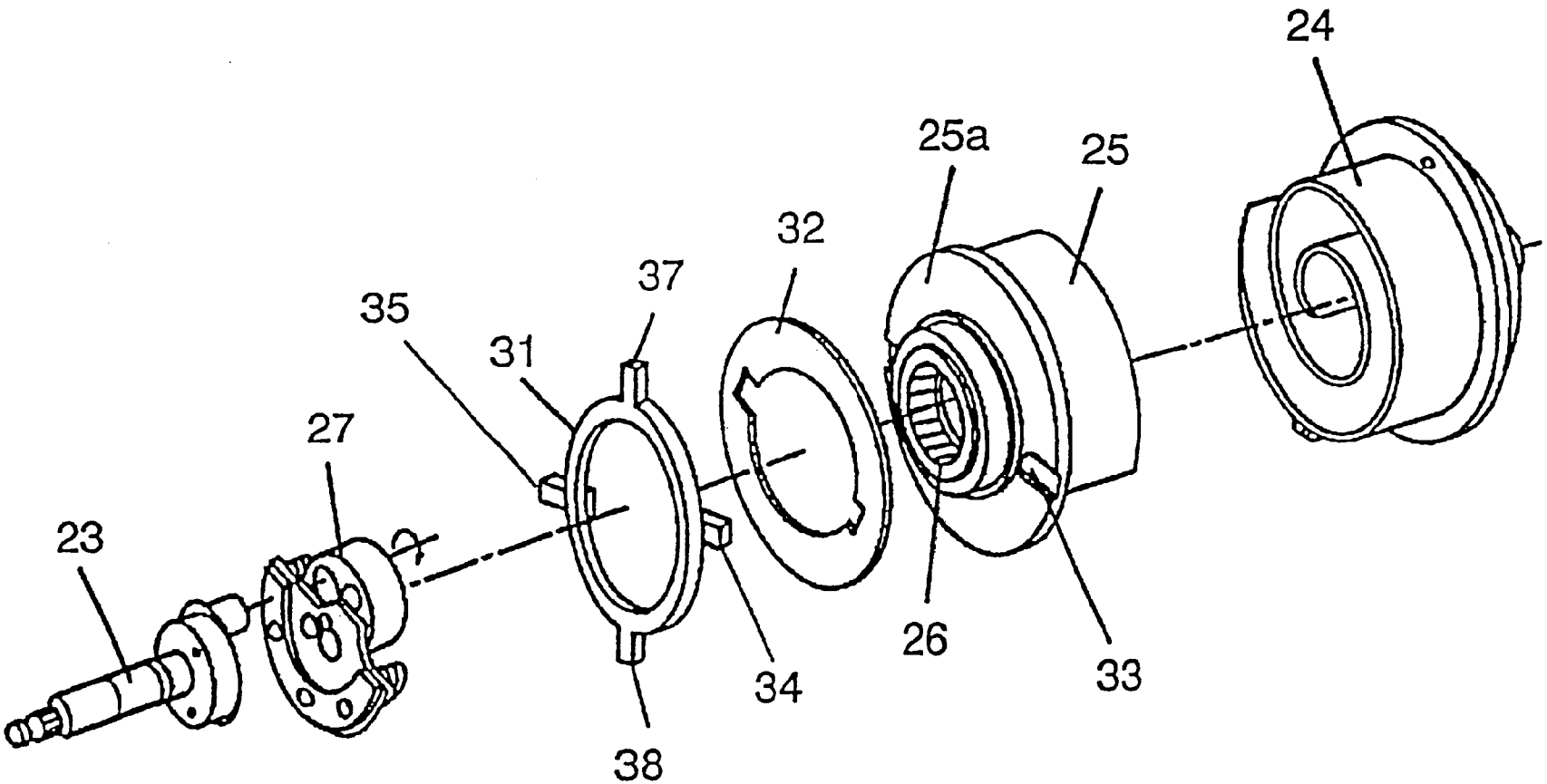
FIG. 2 is an exploded perspective view of an essential part of the scroll compressor.
Figure 3A:
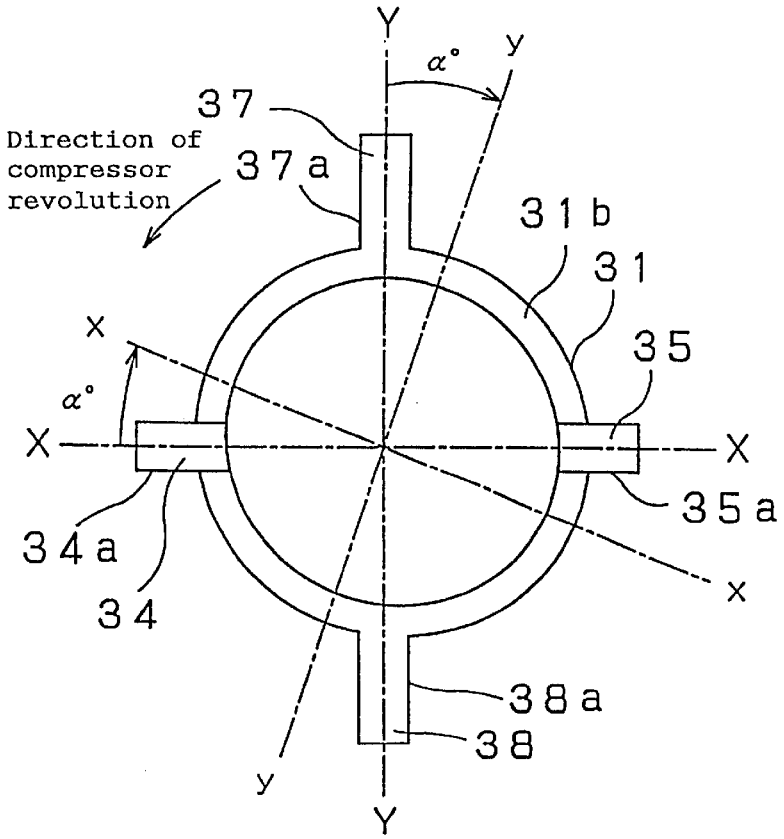
FIGS. 3(*a*) and 3(*b*) are respectively a plan view and a side view of an Oldham's ring of the scroll compressor.
Figure 3B:
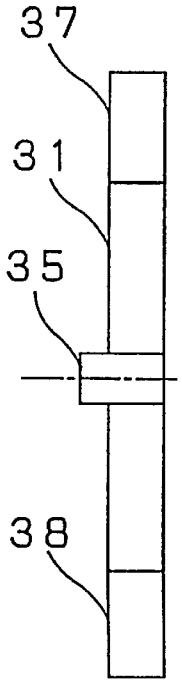

First Exemplary Embodiment:

FIGS. 1 and 2 are respectively a cross-sectional view and an exploded perspective view of an essential part of a scroll compressor in a first exemplary embodiment of the present invention. FIGS. 3(*a*) and 3(*b*) are respectively a plan view and a side view of an Oldhar's ring of the scroll compressor.

In these drawings, a housing 21, a bearing 22, a shaft 23, a fixed scroll 24, an orbiting scroll 25, an orbiting scroll end plate 25*a*, an orbiting bearing 26, an orbiting bushing 27, a suction port 28, a housing 29 on the high pressure side, a discharge port 30, an Oldham's ring 31, and a thrust plate 32 are the same as those in the aforedescribed prior art and description will be omitted. The difference of the present embodiment from the prior art lies in the Oldham's rin& in particular to a change made in the configuration.

A rotation preventing mechanism comprises first engagement means movable between the Oldham's ring 31 and the orbiting scroll 25 only in a first radial direction (direction of the X-axis) shown in FIGS. 3(*a*) and 3(*b*), and second engagement means movable between the housing 21 and the Oldham's ring 31 only in a second. radial direction (direction of the Y-axis) perpendicular to the first radial direction (direction of the X-axis), and the first engagement means comprises a pair of key ways 33 (first keys ways) provided on the orbiting scroll end plate 25*a* in the first radial direction (direction of the X-axis) and a pair of first keys 34, 35 respectively fitting with each of the key ways and provided on the Oldham's ring 31 and slidable along the first key ways 33 and the thrust plate 32. The second engagement means comprises a pair of key ways (second key ways, not shown) provided on the housing 21 in the second radial direction (direction of the Y-axis) and a pair of second keys 37, 38 provided on the Oldham's ring 31 respectively fitting with each of the key ways and slidable along the second key ways and the thrust plate 32. Similar to the above-described prior art example, rotation of the orbiting scroll 25 is hampered while orbiting motion of the orbiting scroll 25 is allowed by the first and second engagement means.

Figure 4A:
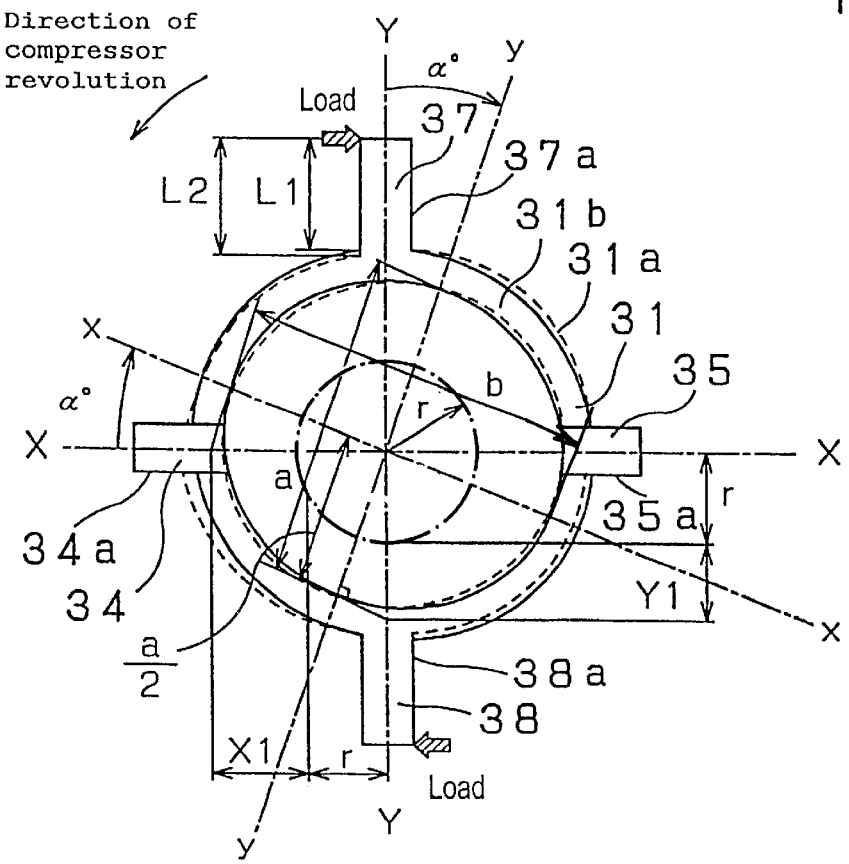
FIGS. 4(*a*) and 4(*b*) are respectively a plan view and a side view illustrating dimensional relationship of the Oldham's ring.
Figure 4B:
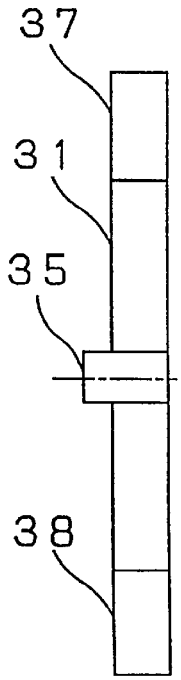

Here, as shown in FIGS. 3(*a*)–4(*b*), the Oldham's ring 31 is configured in a manner such that a rotated elliptical ring 31*b* is formed on an x-y coordinate by rotating only the elliptical ring 31*a* (shown by the dotted lines in FIG. 4(*a*)), having axes of coordinates on the X-axis on the side of the major axis where the first keys 34, 35 are located and on the Y-axis on the side of the minor axis where the second keys 37, 38 are located, by a predetermined angle α in a direction reverse to the rotation of the shaft 23, and opposingly disposing on the rotated elliptical ring 31*b* the pair of first keys 34, 35 and the pair of second keys 37, 38 respectively on the X-axis and the Y-axis.

By the way, the formation of the above-mentioned Oldham's ring 31 may also be made, in an elliptical ring (equivalent to the rotated elliptical ring 31*b*) having the major axis and the minor axis respectively on the x- and y-axes of coordinates shown in FIG. 3(*a*), by rotating the first keys (not shown), and the second keys (not shown) which are similar to those described above and disposed on the x- and y-axes of coordinates on the rotated elliptical ring 31*b*, by a predetermined angle α in the same direction as the direction of rotation of the shaft 23 in a manner such that each of the first and the second key pairs are opposingly disposed on the rotated elliptical ring 31*b* to obtain the first keys 34, 35 and the second keys 37, 38 as illustrated.

By employing the above configuration, as the length of arm from the point of stress concentration on the base of the key portion is shortened from L2 in the prior art to L1 on the load-imposed sides 34*a*, 35*a*, 37*a*, and 38*a* of the first keys 34, 35 and the second keys 37, 38, the bending moments of the keys of the Oldham's ring can be reduced without increasing their weights and the stress concentration on the base of the keys can be relieved. As a result, it becomes possible to enhance the strength of the key portions without increasing the ring width of the ring portion, ring diameter or the key widths, thereby achieving miniaturization of the Oldham's ring 31 as well as achieving low-vibration, light weight, and miniaturization of the scroll compressor as a whole.

Here, it is to be noted that, as the angle α and the length of one of the keys are in a proportional relationship, when too large a value of α is chosen the diameter of the compressor body increases because of the dimensional configuration of the compressor as a whole. Consequently, it is most appropriate that the angle a satisfies the Eqns. (1) and (2).

$$Y=2Y1=(a/\cos\alpha)-2r>2R0 \quad (1)$$

$$X=2X1=(b/\sin\alpha)-2r>2R0 \quad (2)$$

Here, R0 is the orbiting radius, r is the distance of eccentricity of the orbiting bushing relative to the shaft. Also, as shown in FIG. 4(*a*), "a" is the length of an ellipse along the y-axis, and "b" is the length of the ellipse along the x-axis.

Figure 5A:
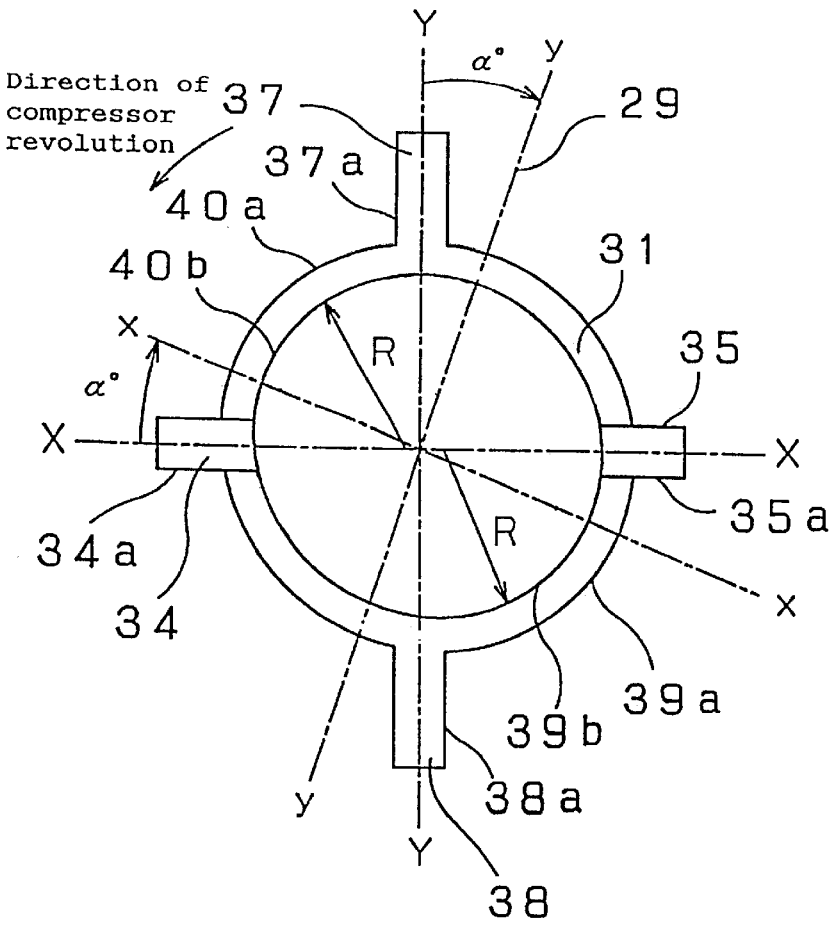
FIGS. 5(*a*) and 5(*b*) are respectively a plan view and a side view of an Oldham's ring in a second exemplary embodiment of the present invention.
Figure 5B:
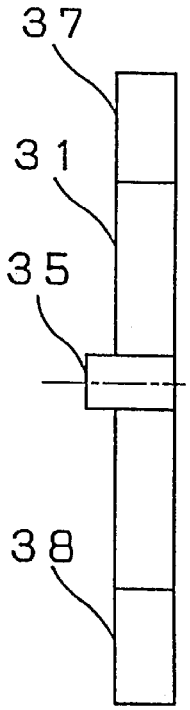
Figure 6:
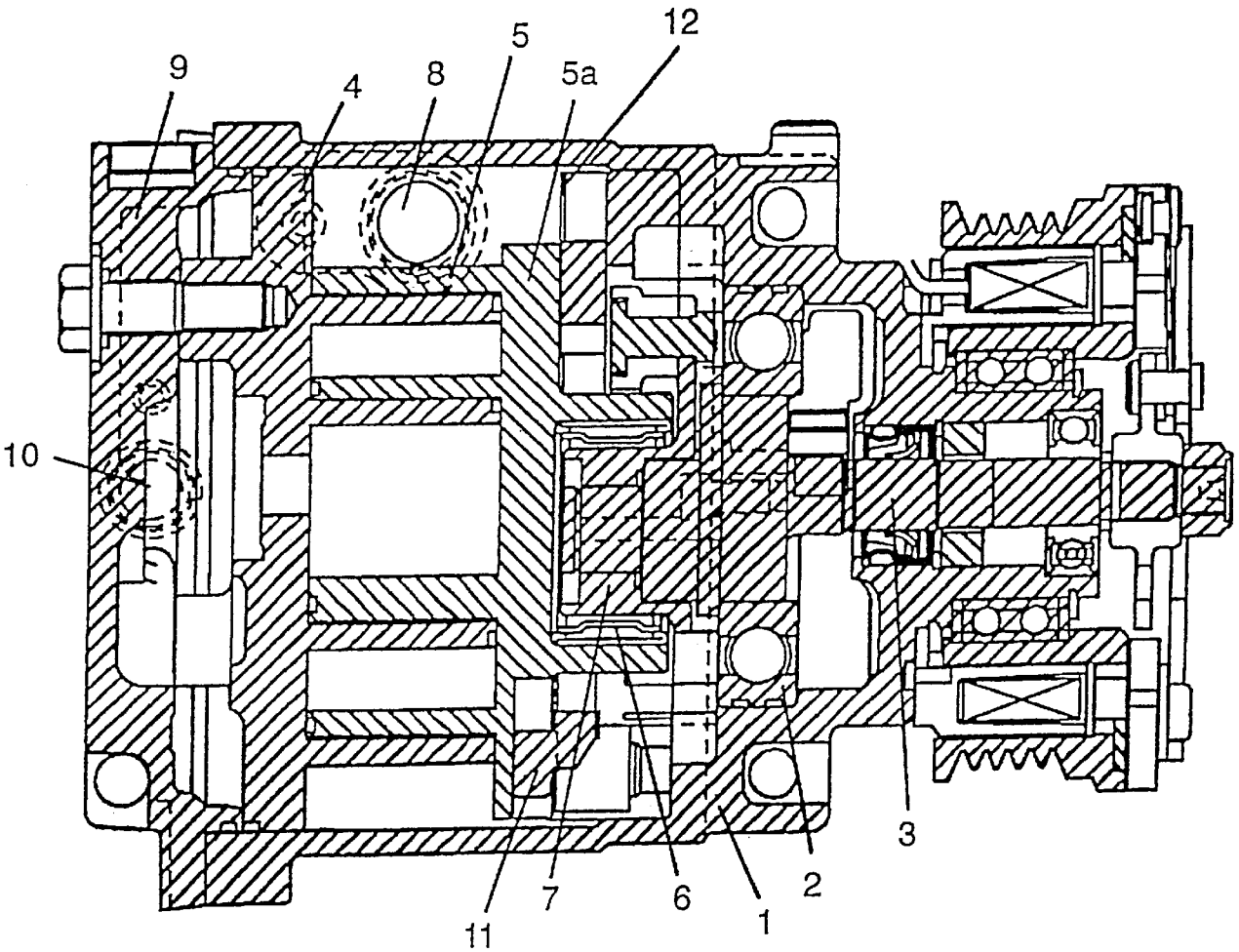
FIG. 6 PRIOR ART
FIG. 6 is a cross-sectional view of a prior art scroll compressor.
Figure 7B:
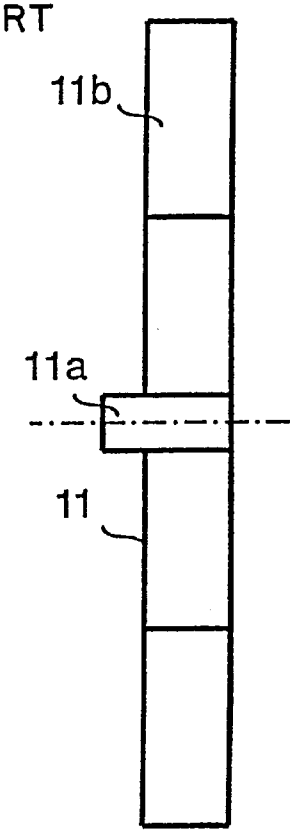
FIG. 7(b) PRIOR ART
FIGS. 7(*a*) and 7(*b*) are respectively a plan view and a side view of an Oldham's ring of the scroll compressor.
Figure 7A:
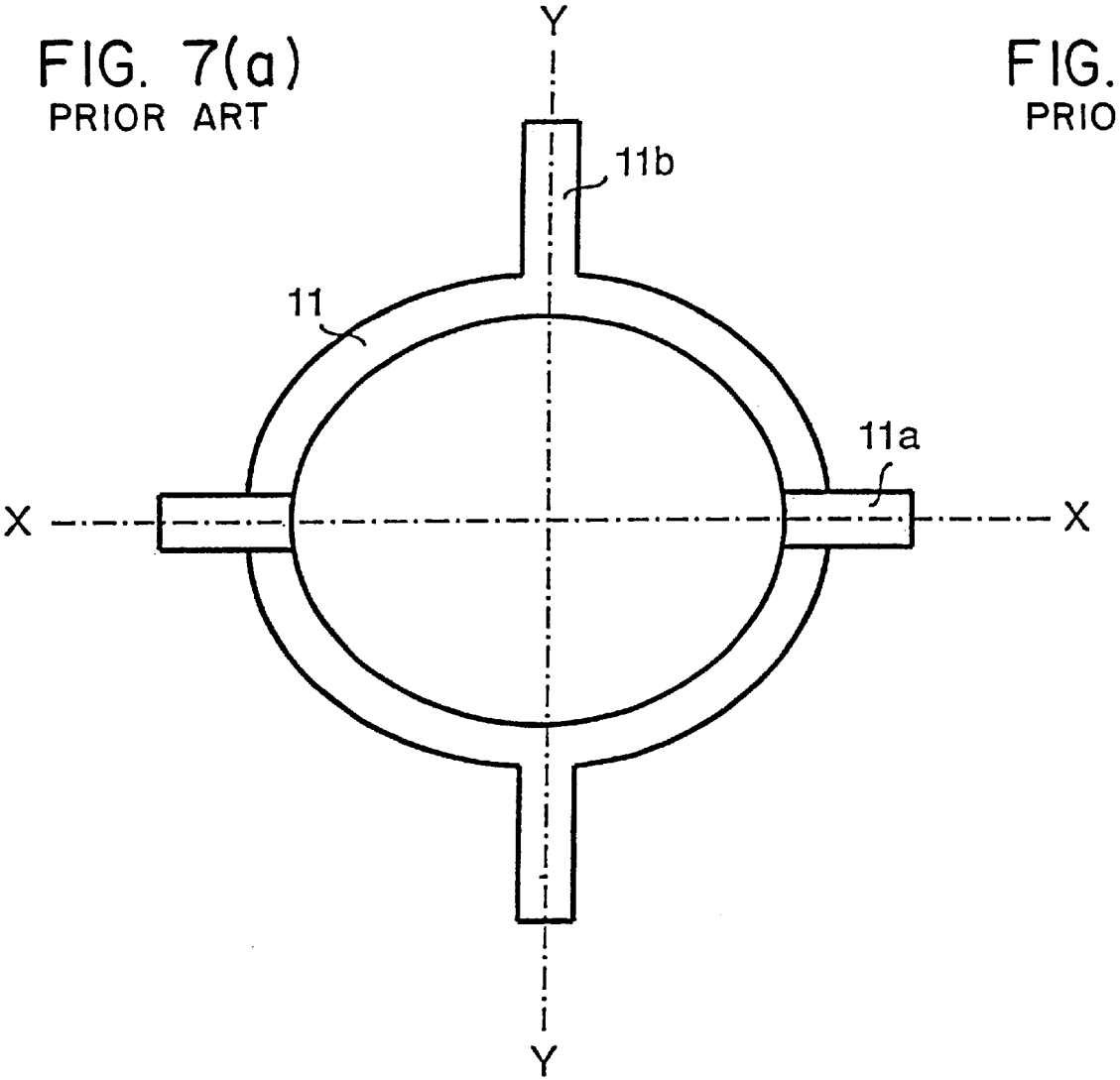
FIG. 7(a) PRIOR ART

Second Exemplary Example:

FIGS. 5(*a*) and (*b*) are respectively a plan view and a side view of an Oldham's ring in a second exemplary embodiment. As illustrated, the Oldham's ring 31 is configured in a manner such that a part of the elliptical curve between the X-axis on the side of the major axis and the Y-axis on the side of the minor axis of a rotated elliptical ring 31*b* is composed of arcs 39*a*, 39*b*, 40*a*, and 40*b* having a predetermined radius (R). With this configuration, the bending moments of the keys themselves are further reduced and the stress concentration on the bases of the key portions can be relieved. As a result, further miniaturization of the Oldham's ring 31 can be achieved.

INDUSTRIAL APPLICATION

As is clear from the above description, in the scroll compressor in accordance with the present invention, an Oldham's ring as a rotation preventing mechanism is configured in a manner such that an elliptical ring having axes of coordinates of the minor and the major axes respectively in a first radial direction and in a second radial direction is rotated by a predetermined angle in the direction reverse to the direction of rotation of the shaft, and first keys in the first radial direction and second keys in the second radial direction are respectively opposingly disposed on this rotated elliptical ring. With this configuration, it is possible to relieve the bending moments of the keys as the length of arms from the point of stress concentration on the bases of the key portions on the load-imposed side of each key can be shortened without increasing the ring width, ring diameter or key widths of the Oldham's ring, thereby allowing control of vibration during high-speed, high-pressure operation and enhancement of durability of the key portions.

Also, by configuring a part of the elliptical curve between the axis of coordinates on the major axis side and the axis of coordinates on the minor axis of the rotated elliptical ring with an arc in accordance with the present invention, the bending moment of each key can be reduced without increasing the ring width, ring diameter, or key width.

As set forth above, the present invention provides a highly reliable scroll compressor by improving the configuration of the ring member of the Oldham's ring only without enlarging the rotation preventing mechanism or employing a complicated configuration.

What is claimed is:

1. A scroll compressor including:

a fixed scroll having a fixed scroll end plate and a spiral fixed wrap on said fixed scroll end plate;

a housing to which said fixed scroll end plate is secured;

an orbiting scroll having an orbiting scroll end plate and a spiral orbiting wrap on said orbiting scroll end plate;

a compression chamber formed by intermeshing said fixed wrap and said orbiting wrap;

a drive mechanism comprising a shaft to drive said orbiting scroll and an orbiting member;

a rotation preventing mechanism having an Oldham's ring disposed in parallel to said orbiting scroll end plate and permitting orbiting motion of said orbiting scroll relative to said fixed scroll while hampering its rotation;

wherein said rotation preventing mechanism comprises:

a first engagement mechanism disposed in between said Oldham's ring and said orbiting scroll and reciprocatingly movable only in a first radial direction; and a second engagement mechanism disposed in between said Oldham's ring and said housing and reciprocatingly movable only in a second radial direction substantially perpendicular to said first radial direction;

said first engagement mechanism comprising:

a pair of first key ways provided on said orbiting scroll end plate in the first radial direction; and a pair of first keys provided on said Oldham's ring, each of said first keys being respectively inserted and fitted in said first key ways and slidable along said first key ways;

said second engagement mechanism comprising:

a pair of second key ways provided on said housing in a second radial direction; and a pair of second keys provided on said Oldham's ring, each of said second keys being respectively inserted and fitted in said second key ways and slidable along said second key ways; and said Oldham's ring being provided with said first keys and second keys opposingly disposed on a rotated elliptical ring formed by rotating an elliptical ring, having the major axis and the minor axis respectively in said first radial direction and in said second radial direction, by a predetermined angle in the direction reverse to the direction of rotation of said shaft.

2. The scroll compressor of claim 1 wherein a part of an elliptical curve between the axis of coordinates on the major axis side and the axis of coordinates on the minor axis side of the rotated elliptical ring is configured with an arc.

* * * * *